US005131437A

United States Patent [19]

Shaw et al.

[11] Patent Number: 5,131,437

[45] Date of Patent: Jul. 21, 1992

[54] DEVICE FOR RETRIEVING THE END OF THE YARN ON A YARN-FEED SPOOL

[75] Inventors: Henry Shaw, Vleteren; Roger Ligneel, Beselare, both of Belgium

[73] Assignee: Picanol N.V., naamloze vennootschap, Belgium

[21] Appl. No.: 593,809

[22] Filed: Oct. 5, 1990

[30] Foreign Application Priority Data

Oct. 6, 1989 [BE] Belgium ..... 8901072

[51] Int. Cl.[5] ..... D03D 47/34; B65H 49/00

[52] U.S. Cl. ..... 139/450; 242/18 R; 242/35.60 E

[58] Field of Search ..... 242/35.6 E, 35.6 R, 242/35.5 R, 78 R; 139/450

[56] References Cited

U.S. PATENT DOCUMENTS

| | | | |
|---|---|---|---|
| 4,606,509 | 8/1986 | Hiroaki | 242/35.6 E X |
| 4,681,271 | 7/1987 | Matsui et al. | 242/18 R |
| 4,705,224 | 11/1987 | Akiyama et al. | 242/35.6 E |
| 4,735,369 | 4/1988 | Suzuki | 242/18 R |
| 4,798,348 | 1/1989 | Matsui et al. | 242/35.6 E |
| 4,842,206 | 6/1989 | Kawasaki et al. | 242/18 R |
| 4,909,451 | 3/1990 | Kuepper et al. | 242/35.6 E X |
| 4,921,179 | 5/1990 | Surkamp et al. | 242/18 R |

FOREIGN PATENT DOCUMENTS

| | | |
|---|---|---|
| 0311169 | 4/1989 | European Pat. Off. . |
| 0311171 | 4/1989 | European Pat. Off. . |
| 1760243 | 12/1971 | Fed. Rep. of Germany . |
| 2426724 | 7/1975 | Fed. Rep. of Germany . |
| 1492166 | 8/1967 | France . |
| 2321446 | 3/1977 | France . |
| 61-145085 | 7/1986 | Japan . |
| 411648 | 4/1966 | Switzerland . |
| 590175 | 7/1977 | Switzerland . |
| 2008161A | 5/1979 | United Kingdom . |

*Primary Examiner*—Stanley N. Gilreath
*Attorney, Agent, or Firm*—Bacon & Thomas

[57] ABSTRACT

A device for retrieving the end of yarn wound on a yarn-feed spool includes a system for blowing an essentially tangentially directed current of air over a rotating yarn-feed spool so that an end of the yarn wound on the yarn-feed spool can be freed from the spool. A suction nozzle is provided to capture and draw into the nozzle the end of the yarn blown free from the spool. A movable carriage system carrying at least the air current generating means and the suction nozzle is provided so that a yarn-feed spool can be approached, exposed to the air current and the freed yarn end captured by the suction nozzle. The mobile system may also carry a device for engaging the driving the yarn-feed spool in rotation. A conveyor system for moving the retrieving system over a weaving machine is also described.

20 Claims, 10 Drawing Sheets 1
3
7
14
6
4
40
39
41
37
9
11
22
5
8
10
26
15
17
27
30
33
16
18
19
31
28
29
25
20
32

7
3
26
14
6
27
37
4
11
8
22
9
10
5
6
15
17
30
33
16
18
19
21
31
28
29
25
20
32

Fig. 16
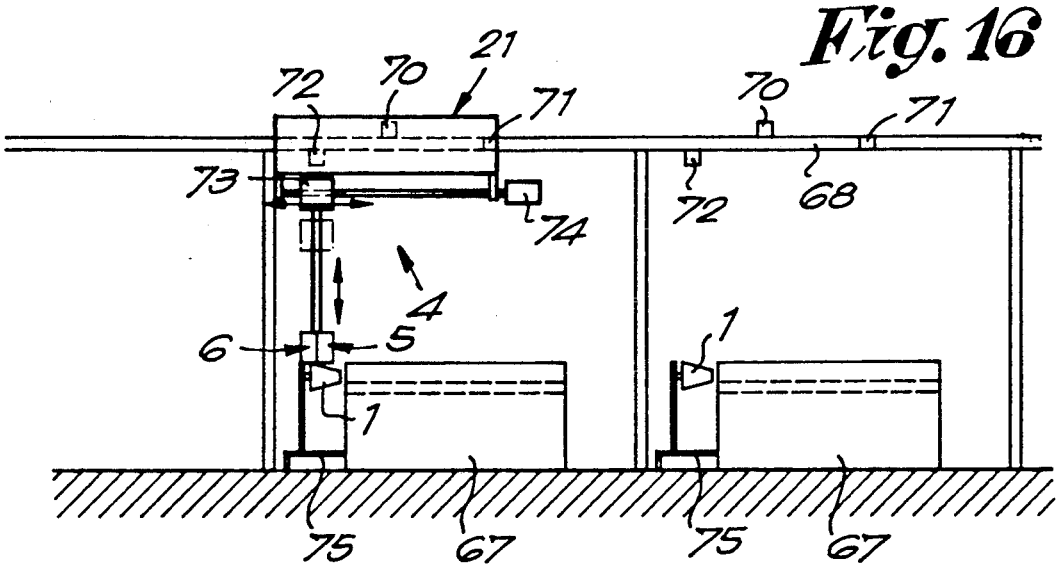
Fig. 17
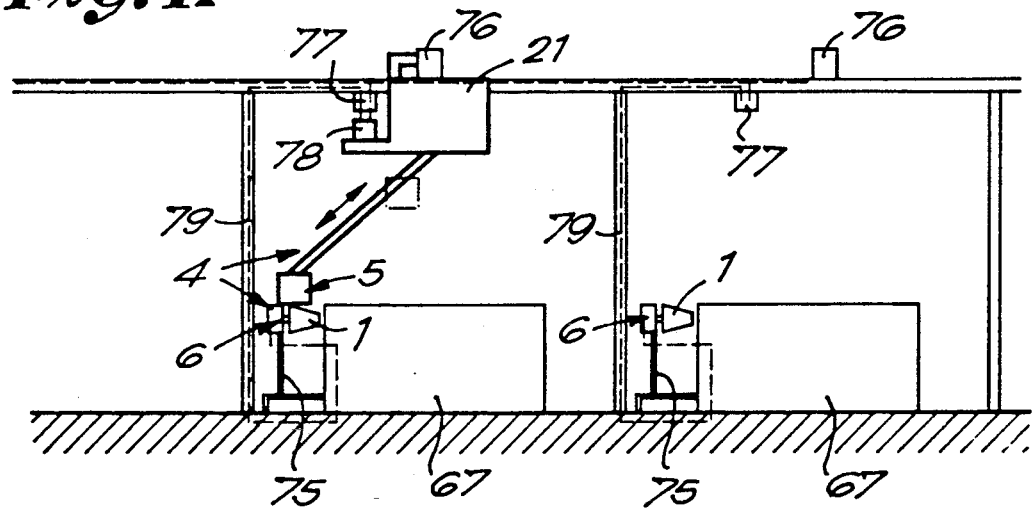
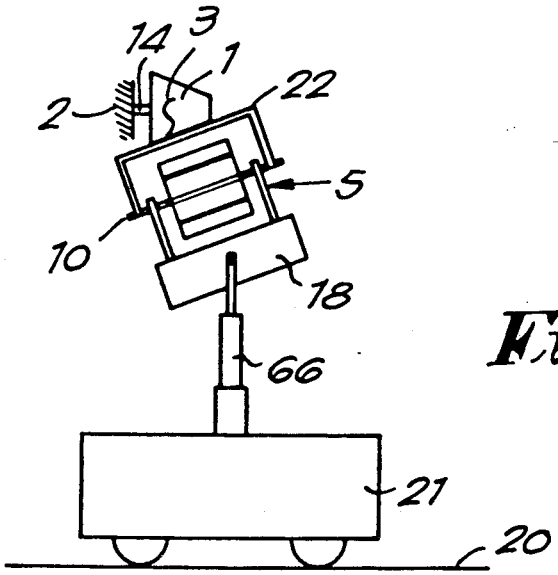
Fig. 12

DEVICE FOR RETRIEVING THE END OF THE YARN ON A YARN-FEED SPOOL

BACKGROUND OF THE INVENTION

This invention relates to a device for retrieving the end of the yarn of a yarn-feed spool. More specifically, this is a device which enables to seek out and retrieve the end of the yarn on any given yarn-feed spool, irrespective of the diameter of the spool and length of the yarn-feed spool or of the conical nature of the surface of the spool.

The devices most commonly used for seeking out the end of the yarn on a yarn-feed spool have the disadvantage of only being able to be implemented in respect of a specific type of yarn-feed spool, this being the case, the application of such devices is therefore limited.

BRIEF DESCRIPTION OF THE INVENTION

This invention relates to device which overcomes this problem.

Such is the aim of the invention, a device which retrieves the end of the yarn on a yarn-feed spool, characterized in that it consists in the main of means which generate an essentially tangentially directed current of air over a yarn-feed spool, means which, by means of a rotational movement, can bring the entire surface of the yarn-feed spool into contact with the air current; at least one suction inlet which is designed to function in conjunction with one side of the yarn-feed spool, in order so as to retrieve an end of the yarn thus blown away from the surface together with presentation elements which provide for the presentation to each other of the yarn-feed spool, and of the means generating the air current and the suction inlet.

BRIEF DESCRIPTION OF THE DRAWINGS

In order to explain the characteristics of this invention, by way of illustration only, and without being in any way limitative, the following preferred embodiments are described with reference to the accompanying drawings, whereby:

FIG. 12 is a schematic view of a variant of the device in accordance with the invention;

FIGS. 16 and 17 are schematic views similar to those of FIGS. 13-15 showing variants of a device in accordance with the invention which runs on tracks throughout the weaving mill.

DETAILED DESCRIPTION OF THE PREFERRED EMBODIMENTS

Figure 1:
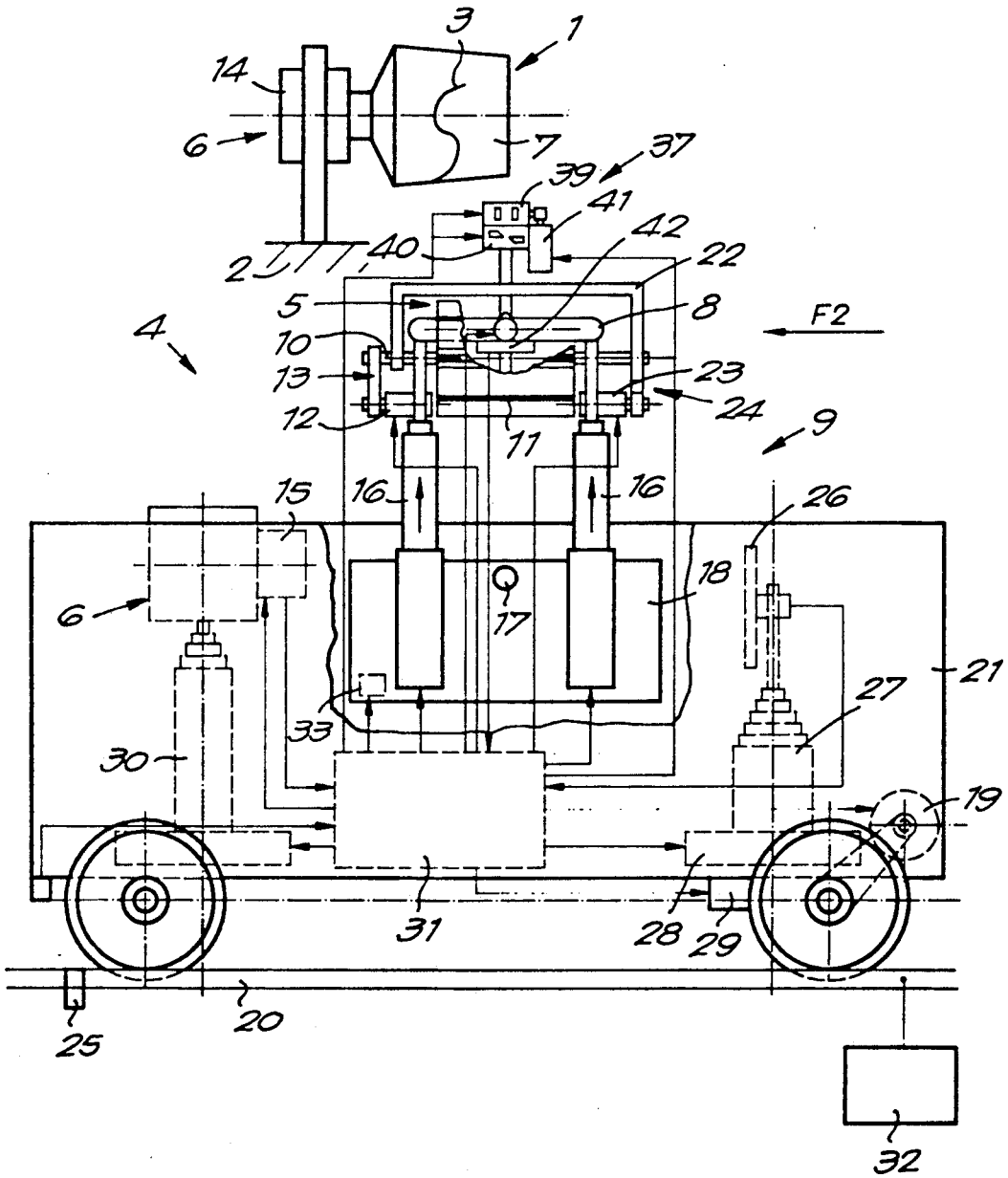
FIG. 1 is a partially schematic plan view of a device in accordance with the invention.
Figure 2:
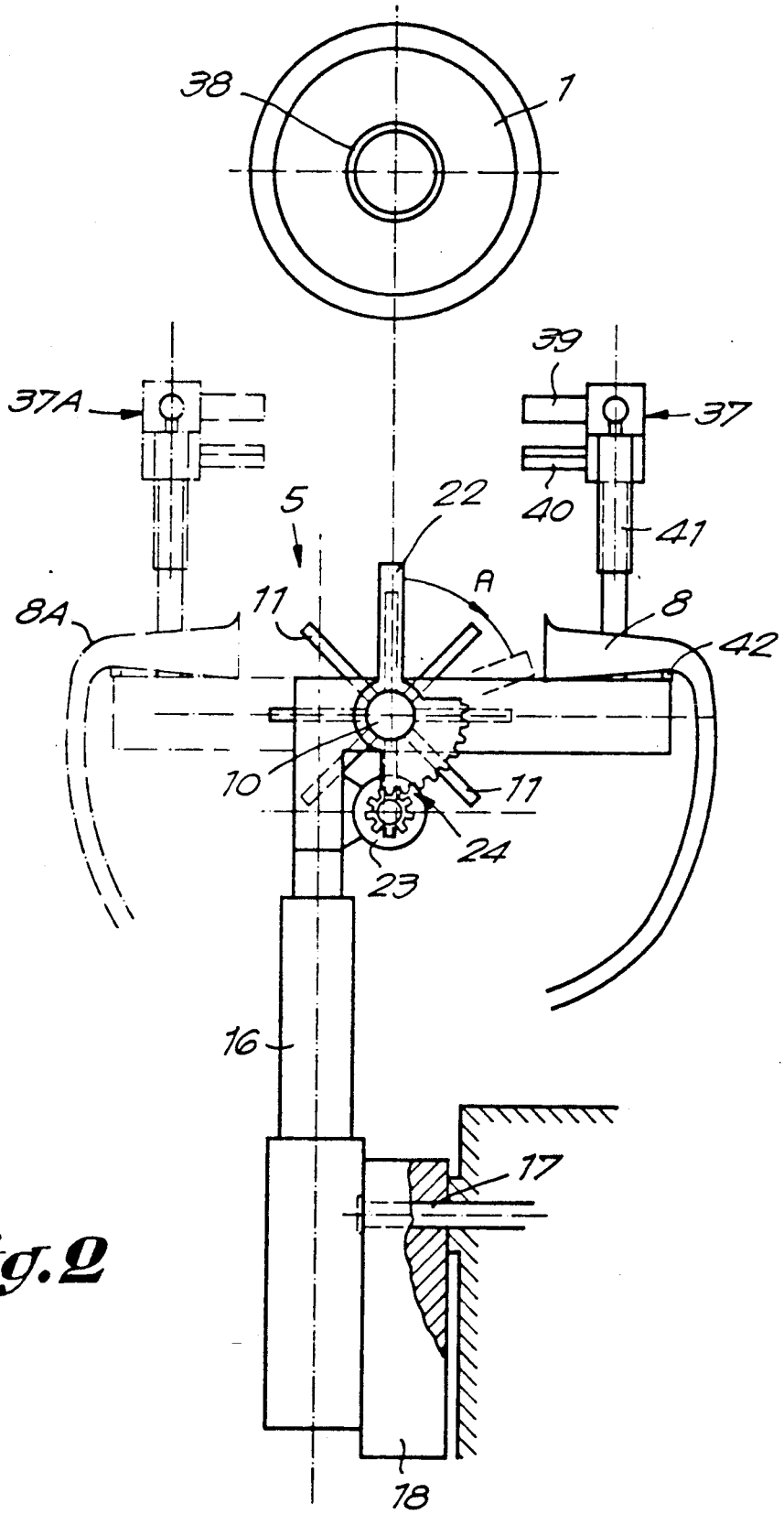
FIG. 2 is an elevated plan view taken in the direction of arrow F2 in FIG. 1.

FIGS. 1 and 2 show a yarn-feed spool (1) which is attached to a support (2), the end of the yarn (3) of which is to be sought and retrieved. This invention provides for a device (4) which in the main consists of means (5) which are essentially capable of generating an essentially tangentially directed current of air over the yarn-feed spool (1); means (6) which, by a rotational movement, can bring the entire surface (7) of the yarn-feed spool (1) into contact with the air current; at least one suction inlet (8) which is intended to be located next to the yarn-feed spool (1) in order to retrieve the end of the yarn (3) blown loose from the surface (7); and elements (9) which provide for the presentation to each other of the yarn-feed spool (1), and of the means (5) which generate the air current and the suction inlet (8).

The means (5) which generate the air current should preferably consist of a blade wheel (11) borne by an axle (10) driven by an electric motor (12), using, for example, a transmission device (13).

The said means (6), as shown in the embodiment, firstly consist of a bobbin support (14) rotatable in the support (2) and secondly a drive (15) which can operate in conjunction with the rotating bobbin support (14).

The dimensions and installation of the suction inlet (8) should preferably be such that they provide for presentation alongside the axial length of a yarn-feed spool (1), as well as alongside the blade wheel (11). To this end, the inlet should preferably be oblong in shape.

The said presentation elements (9) may be of any type.

Those shown in the embodiment on FIGS. 1 and 2 are a combination of a telescopic support for the blade wheel (11) and the suction inlet (8) using telescopic arms (16)- mounted on both sides of it; a hinged suspension of the telescopic arms (16) using a support (18) rotating around an axle (17); and a carriage (21) driven by a motor (19), running on tracks (20) or any other guiding element. The aforementioned hinged suspension shall be designed in such a way that, with the telescopic arms (16) extended, the centre of gravity of the hinged part round the axle (17) is located close to the underside of the axle (17).

The presentation elements (9) should preferably comprise a tracer (22) mounted at a short distance along the blade wheel (11), and which shall, for example, form a bracket-shaped element capable of pivoting around the axle (10). The tracer (22) is in rest position on the side where it is intended that the blade wheel (11) be presented to the yarn-feed spool (1) and which tracer, by means of a motor (23) and gear-wheel transmission (24), can be turned sideways in accordance with a movement (A).

In addition, the device also comprises a positioning mechanism which positions the carriage (21) in respect of the yarn-feed spool (1). An element (25) may, for example, be used, such as a sensor, stop or similar, which is positioned along the tracks (20), by means of which an approaching carriage (21) can receive a signal. This being the case, the carriage may slow down or stop, at which point it can be more accurately positioned by means of a sensor (26) which, for example, may be mounted on a telescopic arm (27), which, in turn, may be extended by a driving means (28). In fact, the device shall preferably comprise a brake (29) in respect of the carriage (21), a driving mechanism (30), such as a telescopic drive in order to move the means (6), and a control unit (31) mounted on the carriage (21) which, if required, in conjunction with a fixed control unit (32), such as a computer, may provide for the operation of the various parts, more specifically in accordance with the method, as hereinafter described.

The operation of the device can quite simply be deduced from the figures.

Figure 3:
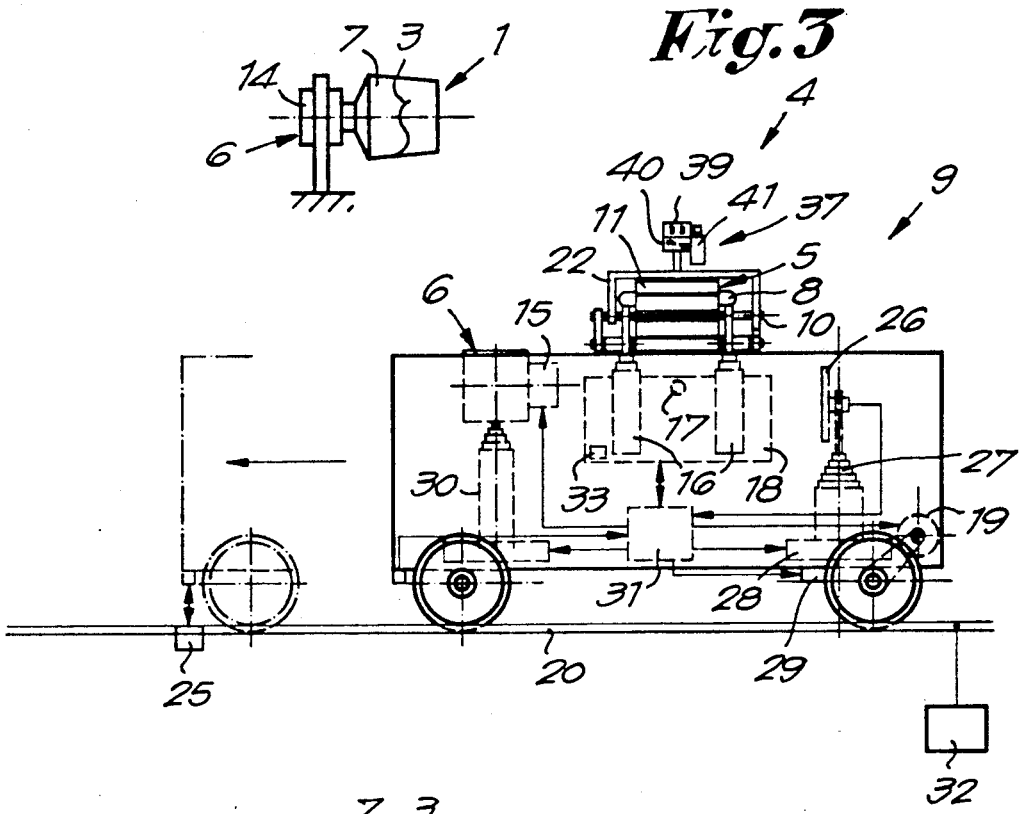
FIGS. 3 to 5 are views similar to that of FIG. 1 showing various positions of the device in accordance with the invention.

As shown in FIG. 3, firstly, the carriage (21) is driven along to the yarn-feed spool (1) by means of a motor (19). The carriage (21) makes contact with the element (25), by which the control unit (31) generates a signal, thus reducing the speed, and the telescopic arm (27) is extended until such time as the sensor (26) reaches the yarn-feed spool (1). The contact between the carriage (21) and the element (25) may be of an optical, magnetic, mechanical or electrical nature.

Figure 4:
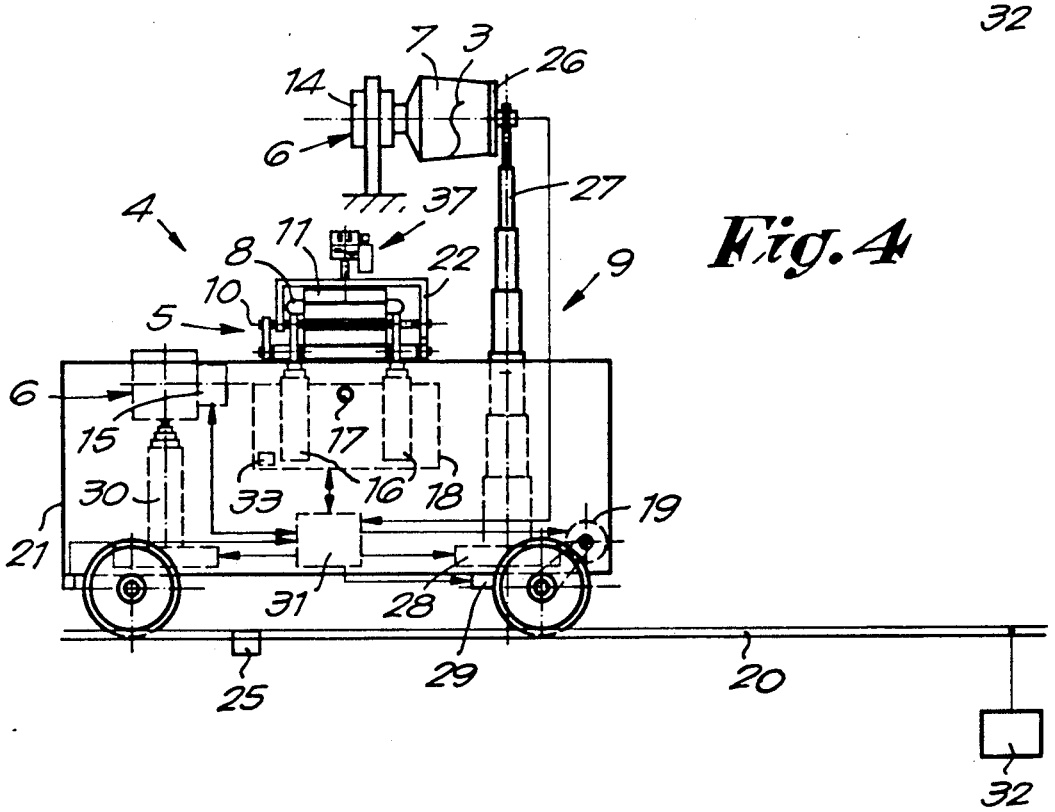

The carriage (21) is stopped as soon as the sensor (26), as shown in FIG. 4, makes contact with the yarn-feed spool (1). Subsequently, the telescopic arm (27) is withdrawn, at which point the carriage (21) is possibly moved over a certain distance D as shown in FIG. 5, thus allowing the blade wheel (11), with the telescopic arms (16) extended, to be correctly positioned in respect of the yarn-feed spool (1).

Figure 5:
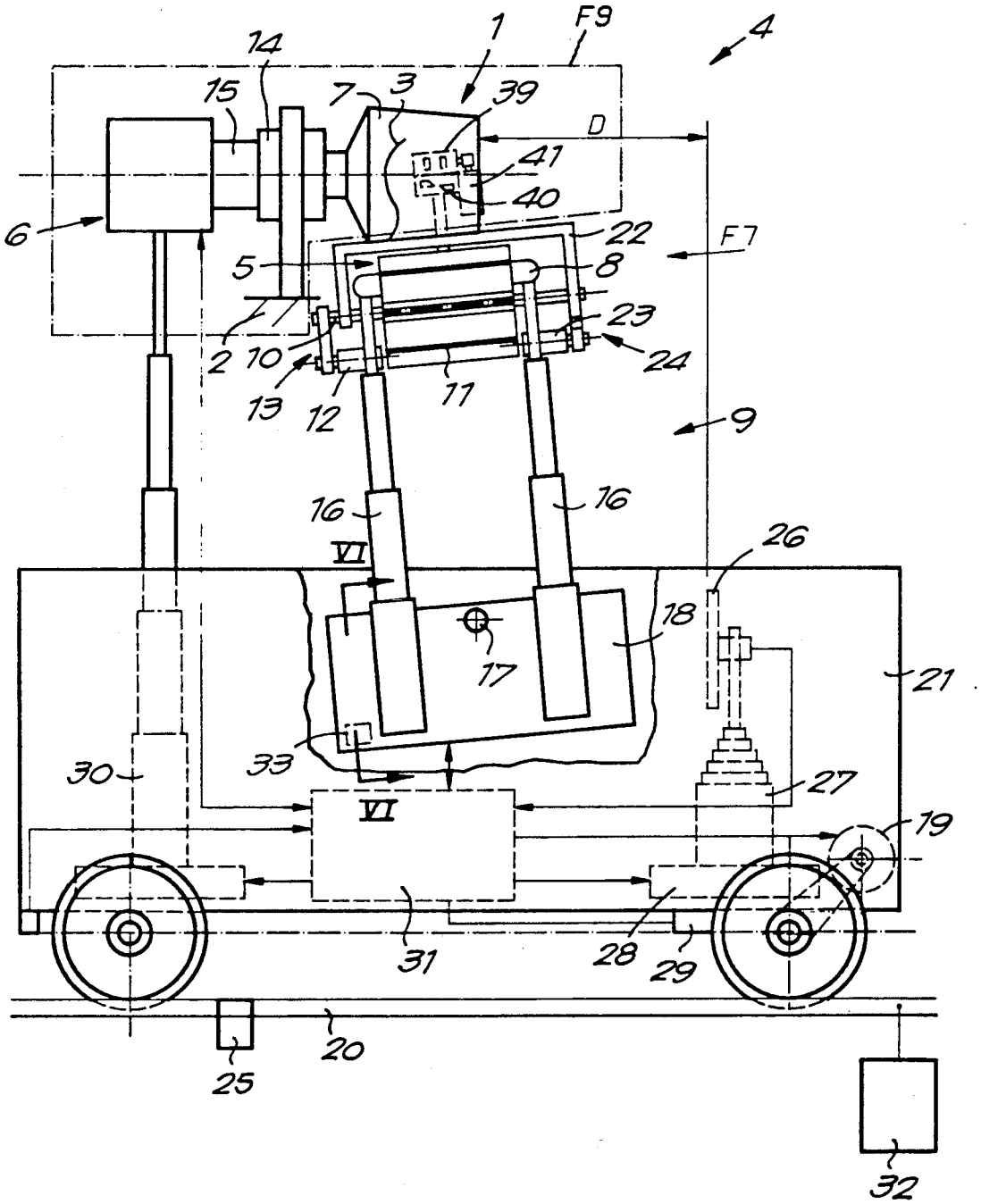

Subsequently, the control unit (31) gives a command to the telescopic arms (16) to extend, resulting in a situation as shown in FIGS. 1 and 2, at which time the tracer (22) is eventually pushed against the surface (7) of the bobbin, as shown in FIG. 5. The tracer (22) firstly makes contact with one side of the conical surface (7). However, due to the force with which the telescopic arms (16) are extended, the whole device tilts over around its axis (17) and is positioned in parallel with the surface (7).

Figure 6:
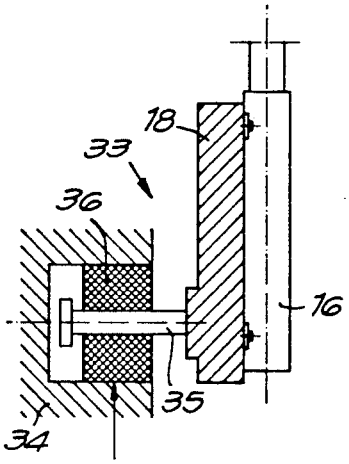
FIG. 6 shows a cross-section according to line VI—VI in FIG. 5.

During the next phase, the support (18) is locked, using an electromagnetic locking device (33), for example, as shown in FIG. 6. This consists of a core (35) around which a winding (36) is fitted and mounted within the frame (34) of the carriage (21). The support (18) will then slide along the core (35) in such a way that, due to the force of the winding (36), it can be locked into any position.

Figure 7:
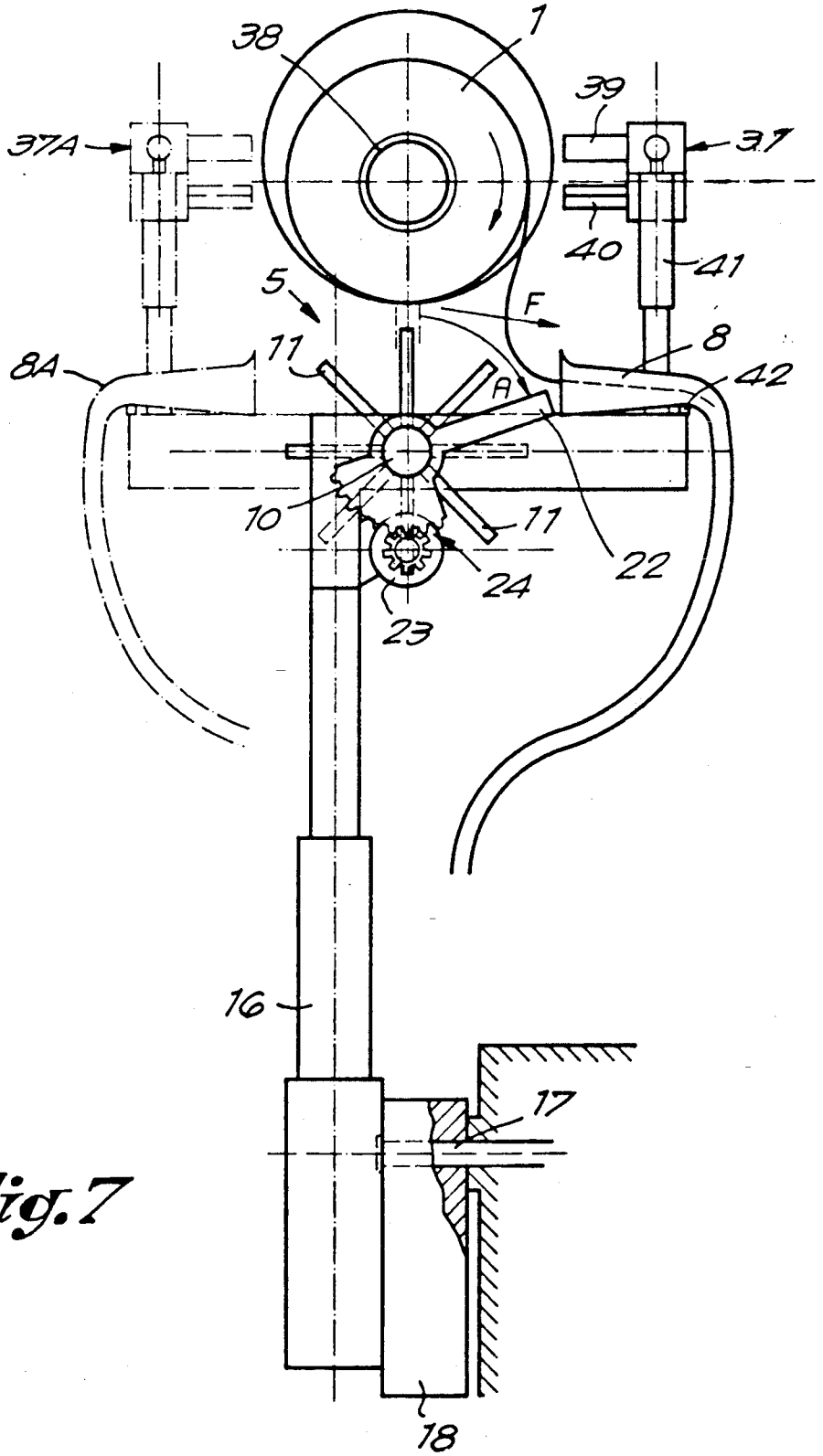
FIG. 7 is an elevated plan view taken in the direction of arrow F7 in FIG. 5.

This is followed, as shown in FIG. 7, by the tracer (22) turning sideways by means of the motor (23) being activated, upon which the blade wheel (11) may possibly be positioned slightly nearer to the yarn-feed spool (1).

At the same time, as schematically shown in FIG. 5, the drive (15) is coupled to the rotating bobbin support (14).

Subsequently, the blade wheel (11), the suction inlet (8) and the drive (15) for the bobbin support (14) are activated, so that, as shown in FIG. 7, the blade wheel (11) rotates in the same direction as the yarn-feed spool (1). As a result, the blade wheel (11) generates a current of air (F) which is reinforced by means of the suction inlet (8). Subsequently, the end of the yarn (3) located along the surface (7) of the yarn-feed spool (1) is retrieved from the yarn-feed spool (1), and drawn into the suction inlet (8). As a result, the end of the yarn (3) can be manipulated in any way, in accordance with the motives for seeking and retrieving the end of the yarn (3).

In accordance with a special embodiment, the device shall also contain means (37) which will take the retrieved end of the yarn (3) to the rotary shaft of the yarn-feed spool (1) in order to feed it into the housing (38) on the yarn-feed spool.

Figure 8:
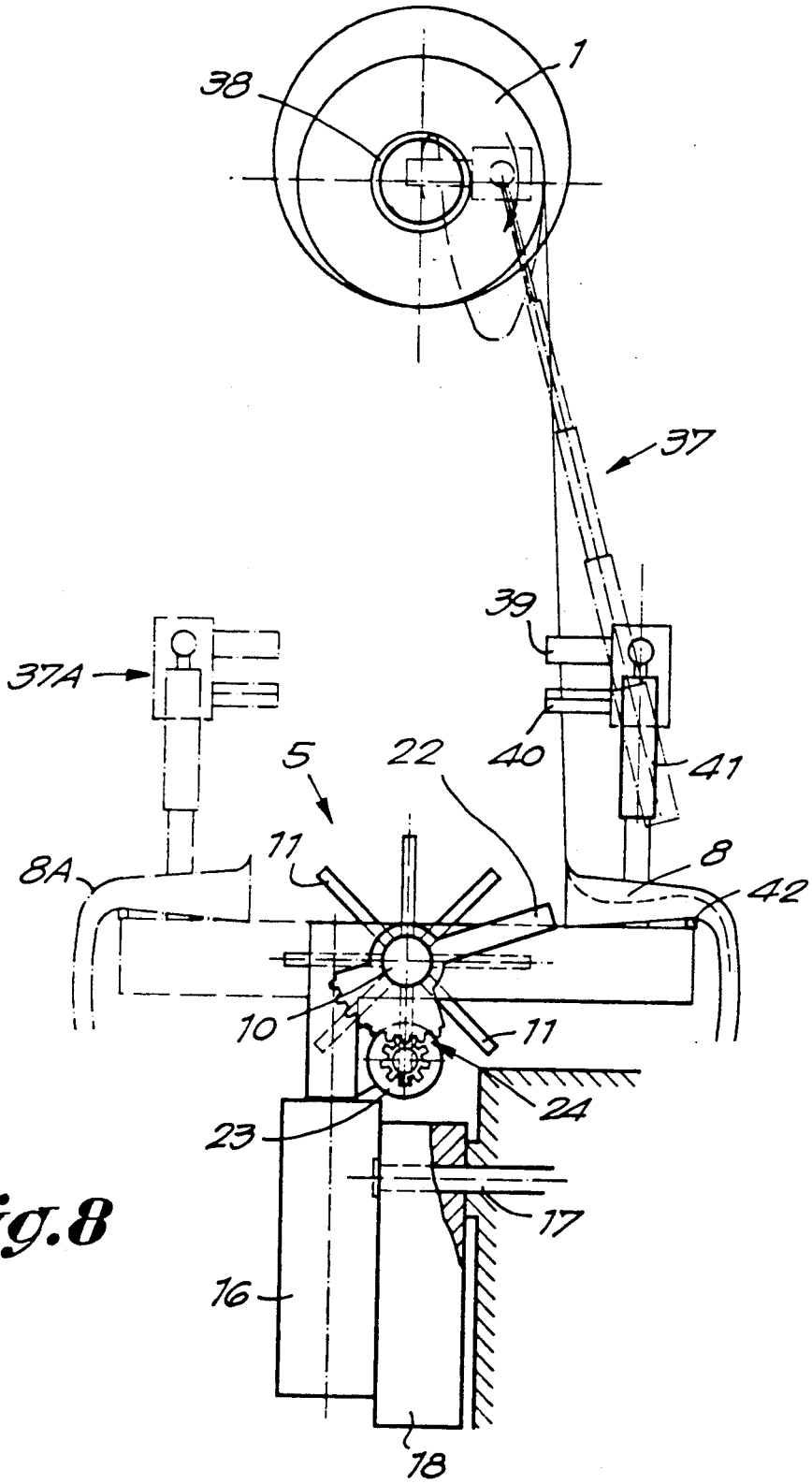
FIG. 8 shows a view similar to FIG. 7 with the device set in a different position.

As shown in FIG. 8, these means (37) shall consist of a yarn clamp (39) mounted near the suction inlet (8) and a cutting device, such as shears (40). The yarn clamp (39) shall be mounted on a moving mechanism (41), such as a telescopic extension arm or such like.

The operation of the means (37) can easily be deduced from FIG. 8: and consists in that the end once the end of the yarn (3) is drawn into the suction inlet (8), the drive of the blade wheel (11) drive and the drive (15) of the yarn-feed spool (1) are deactivated following a signal from the yarn detector (42) located in the suction inlet (8) and the yarn clamp (39) and shears (40) in respect of the yarn-feed spool (1) are moved away, for example by retracting the telescopic arms (16), so that the end of the yarn (3) is automatically placed between the opened yarn clamp (39) and shears (40). Subsequently, the yarn clamp (39) and shears (40) close, with any waste being drawn off via the suction inlet (8) The yarn clamp (39) is then lifted by the moving mechanism (41), to the top of the yarn-feed spool (1) and the end of the yarn (3) is positioned exactly in front of the housing (38). The end of the yarn can be taken into the housing (38) in a variety of ways, as described below, for example, in accordance with FIG. 9.

Figure 9:
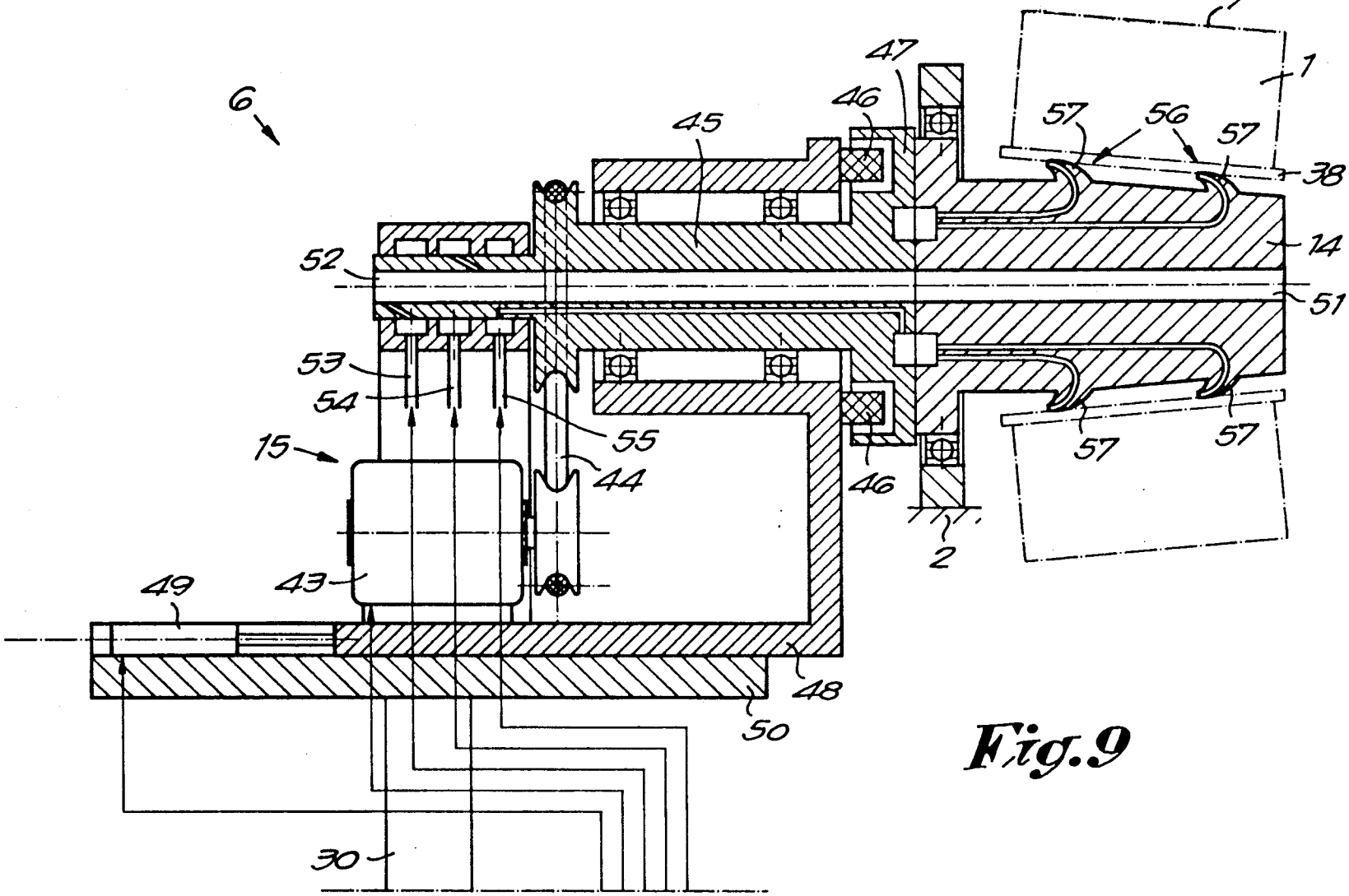
FIG. 9 is a cross-sectional side view of a practical embodiment of the part in FIG. 5 as indicated by F9.

FIG. 9 shows the preferred embodiment of the said means (6) for driving the yarn-feed spool (1). The said drive (15) consists of an electric motor (43) which, via a transmission (44), drives a coupling element (45) which can operate in conjunction with the rotating bobbin support (14). The coupling element (45) should preferably consist of an electromagnetic coupling. The coupling element (45) includes electromagnets (46) and a coupling disc (47) which may be coupled magnetically to the said bobbin support (14).

The whole unit shall be mounted on a support (48) which can be moved sideways by means of a cylinder (49), for example, in relation to a support (50) which, in turn, can be moved up and down by means of the said driving mechanism (30).

Needless to say, once the carriage (21) has been positioned in pace, the support (50) is lifted first, and then the support (48) is moved to the yarn-feed spool (1) using a cylinder (49), at which time a magnetic coupling is established.

As mentioned earlier, in order to feed the end of the yarn (3) into the housing (38) of the yarn-feed spool (1), the bobbin support (14) should preferably be equipped with an intercommunication channel (51) which can operate in conjunction with an intercommunication channel (52) within the coupling element (45), in which, by means of a blower (53), suction can be generated. If required, a blower (54) may also be provided which blows into the channel (52), thus blowing the end of the yarn (3) back out of the channel (51) of the bobbin support (14).

If required, the coupling element (45) may also be equipped with a compressed air connection (55), which, for example, is controlled by the control unit (31), in the event of a bobbin support (14) being used with a pneumatic work-holding device (56). In the event of such pneumatic work-holding devices (56) being used, elastic, flexible parts (57) are placed radially outwards against the housing (38).

Clearly, the compressed air connections can also be implemented in conjunction with other couplings, instead of the aforementioned electromagnetic coupling.

Figure 11:
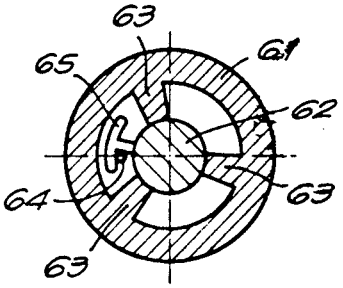
FIG. 11 shows a cross-section according to line XI—XI in FIG. 10.
Figure 10:
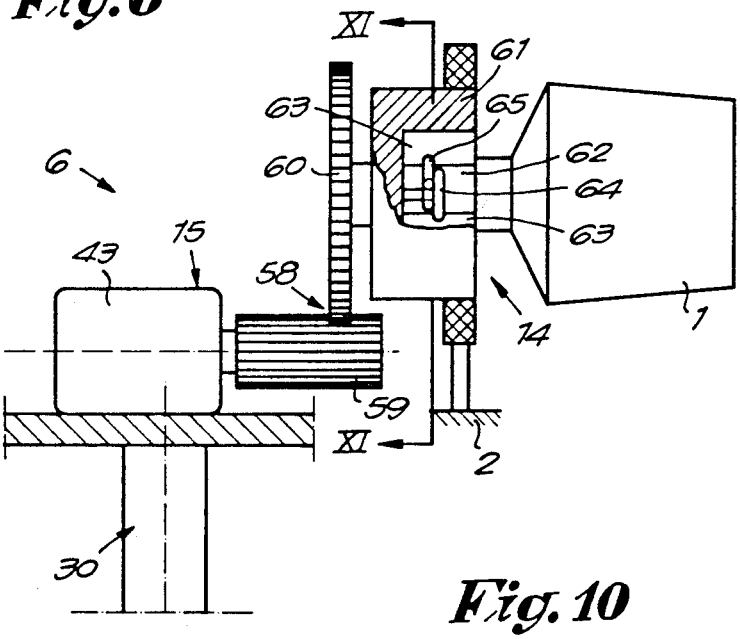
FIG. 10 is a partially cross-sectional plan view of a variant of the part shown in FIG. 9.

FIGS. 10 and 11 show a variant of the means (6), whereby the drive (15) and the rotating bobbin support (14) are brought into contact by means of a gear-wheel connection (58), whereby one gear-wheel (59) is connected to the motor (43), whilst the other gear-wheel (60) is attached to the rotating bobbin support (14). The motor (43) together with the gear-wheel (59) is moved in such a way that the latter engages with the gear-wheel (60), for example by means of a drive mechanism (30), as described above.

In FIGS. 10 and 11, the embodiment comprises a rotating bobbin support (14) which is made up of two parts, and consists of one part (61) mounted within the support (2) and one part (62) locked within the same, upon which the yarn-feed spool (1) can be installed. The part (62) is locked radially within the part (61) by means of grips (63), whilst the axial locking device is enabled by the arrangement of hooks (64) and (65) positioned on both parts (61) and (62). The hooks (64) and (65) should preferably have a two-way span, so that the rotating bobbin support (14) can rotate in both directions. The yarn-feed spools (1) are in the first place installed on the parts (62), upon which the parts (62) are positioned within the parts (61).

It is clear that, as shown in FIG. 2, provision has been made for a second suction inlet (8A) and second means (37A), whereby the motor (12) of the blade wheel (11) and the drive (15) are reversible, allowing yarn-feed spools (1) to be used with other winding directions. Naturally, when a yarn-feed spool (1) with a different winding direction is used, this yarn-feed spool (1) and the blade wheel (11) are driven in the opposite direction from that indicated in FIG. 7. In this way, an air current is generated which is directed towards the suction inlet (8A), and the end of the yarn (3) is drawn into the suction inlet (8A). To this end, provision has been made for means (37A) at the suction inlet (8A), the operation of which being similar to that of the above-mentioned means (37).

Needless to say, the direction of rotation in respect of the yarn-feed spool (1), in accordance with the winding direction of the yarn-feed spool (1) aforesaid, is such that when this yarn-feed spool (1) is driven, the end of the yarn (3) can be drawn further into suction inlet (8) or (8A), as appropriate.

It is obvious that the said means (6) which drive the yarn-feed spool (1) do not necessarily move in conjunction with the carriage (21). They may also be designed to form a fixed unit attached to the bobbin support (14).

In accordance with a variant which is not shown, the means (6) which provide the rotational movement, may also be designed in such a way that the yarn-feed spool (1) is fixed and such that means (6) instead move the blade wheel (11) around the circumference of the yarn-feed spool (1) to obtain the mutual rotational movement required for yarn feeding.

FIG. 12 shows a schematic diagram of a variant whereby the hinged suspension is located at the axle (17) is located on top of the telescopic arm (66). When this arm is extended, there will only be a slight sideways movement of the blade wheel (11) when the tracer (22) comes into contact with the conical yarn-feed spool (1).

Figure 13:
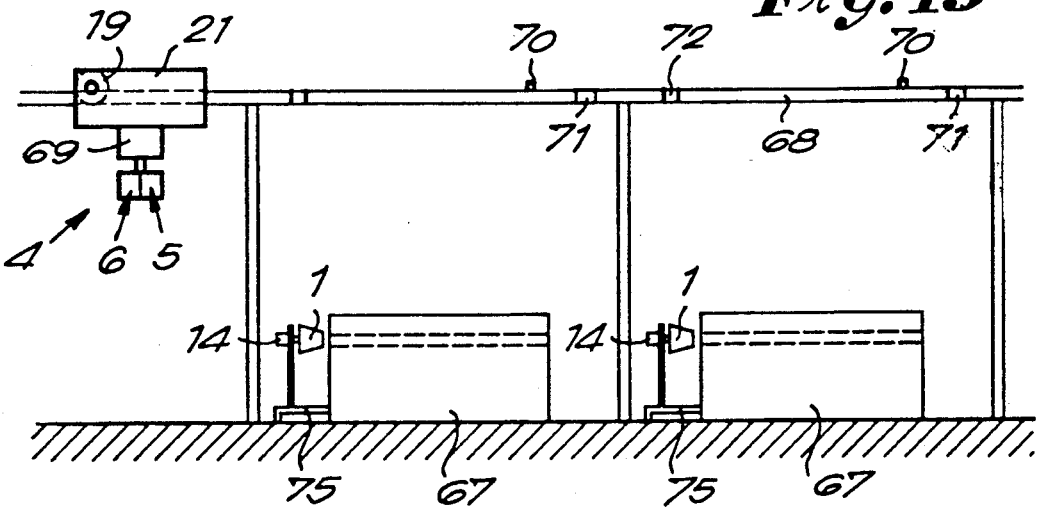
FIGS. 13 to 15 are schematic views showing a device in accordance with the invention for various positions, whereby the device runs on tracks to serve a number of weaving machines.
Figure 14:
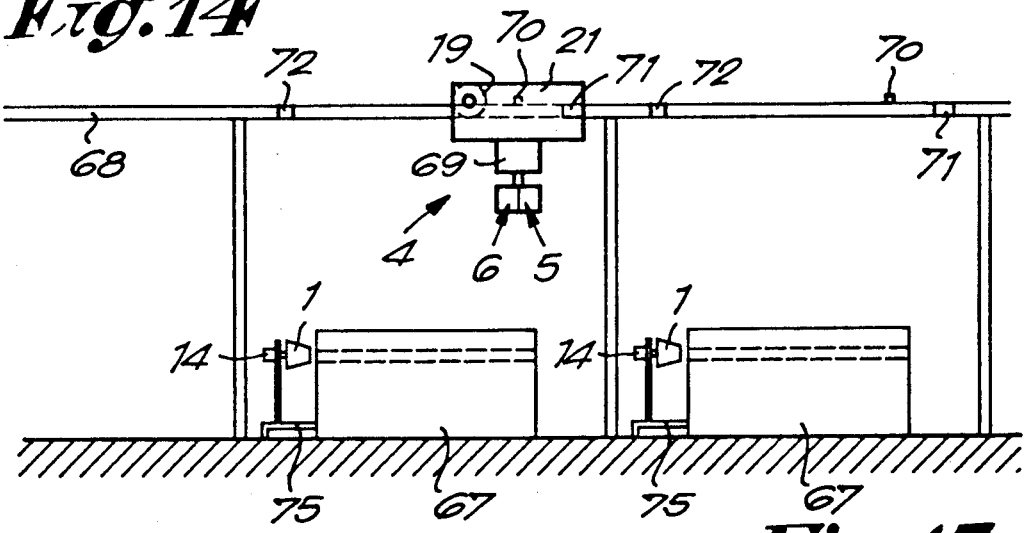
Figure 15:
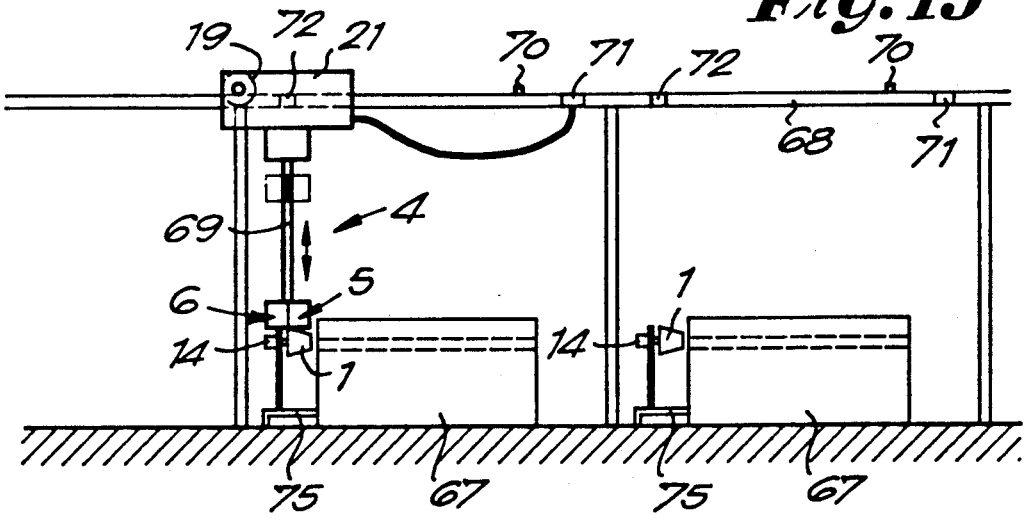

FIGS. 13 to 15 show an application of the device in a weaving-mill whereby the carriage (21) runs on tracks (68) which have been mounted over the weaving machines (67) and the means (5) which generate an air current using an extendable mechanism (69) can be presented to the yarn-feed spools (1) in respect of the weaving machines (67).

FIG. 13 shows a rest position.

FIG. 14 shows a situation in which the carriage (21) is moved towards a detector (70) and the connection to the mains is established via a contact mechanism (71), to provide the necessary electrical and compressed air connections. Subsequently, as shown in FIG. 15, the carriage (21) is moved to a second detector (72) which indicates the position in which the means (5) and (6) are lowered. Such devices have previously been described in published European patent applications EP 311169 and EP 311171 already submitted by the applicant and published on Apr. 12, 1989.

FIG. 16 shows a variant whereby the carriage (21) remains stationary at the detector (70). However, this carriage (21) has its own transport system which runs along a certain distance, whereby a slide (73) can move up to the second detector (72) by means of a motor (74), at which point the means (5) and (6) can be presented to the yarn-feed spools (1).

FIG. 17 shows another variant whereby the means (6) for driving the yarn-feed spool (1) and/or for driving various yarn-feed spools have been incorporated in the bobbin stand (75). When the carriage (21) is taken to the detector (76), the connection is established with these means (6) using contact elements (77) and (78) and a duct (79), in such a way as to activate them at the right time when the means (5) are lowered in order to generate an air current.

Needless to say, all or some of the aforementioned motors can be of the pneumatic type or any other. The rotating support (18) can be equipped with a motor which is responsible for rotating the support (18), whereby the tracer (22), for instance, is provided with proximity switches which operate in conjunction with the aforementioned motor.

This invention is in no way restricted to the embodiments illustrated by way of an example and shown in the figures. However, a number of variants of this device for retrieving the end of the yarn on a yarn-feed spool may be produced without exceeding the limitations of the invention.

We claim:

1. A device for retrieving an end of yarn wound on a yarn-feed spool comprising:

means for generating an essentially tangentially directed current of air over a yarn-feed spool;

means for rotating the yarn-feed spool and the air current generating means relative to one another to bring an entire surface of the yarn-feed spool into contact with the air current;

at least one suction inlet including means for operating same in conjunction with one side of a yarn-feed spool for retrieving an end of yarn blown away from a surface of the spool;

and movable presentation means for bringing a yarn-feed spool on the one hand and the air current generating means and the suction inlet on the other hand, into proximity with each other;

wherein the presentation means comprises a movable support for the air current generating means as well as for the suction inlet, and an adjustable hinged suspension for the air current generating means, whereby an angle of inclination of the movable support is adjustable to cooperate with a conicity of the yarn-feed spool.

2. A device in accordance with claim 1 wherein the air current generating means comprises a blade wheel; motor means for driving the blade wheel; and means connecting the blade wheel and motor means.

3. A device in accordance with claim 1 wherein the suction inlet is oblong in shape and said means for operating same is arranged to locate the suction inlet over an axial length of the yarn-feed spool.

4. A device in accordance with claim 1 wherein the hinged suspension includes a locking device for locking the air current generating means at a desired angular position.

5. A device in accordance with claim 1 including tracer means mounted adjacent the air current generating means, said tracer means including means for making contact with a surface of the yarn-feed spool.

6. A device in accordance with claim 5, wherein said movable support includes an extendable telescopic support and wherein the hinged suspension is coupled to the telescopic support so that, upon extension of the telescopic support, the tracer means rotates to follow the inclination of a yarn-feed spool with which it makes contact.

7. A device in accordance with claim 5 wherein the air current generating means comprises a motor driven blade wheel, and wherein the tracer means comprises a bracket-shaped element pivotable about an axis of rotation of the blade wheel; and means for pivoting the bracket-shaped element around the axis of rotation of the blade wheel.

8. A device in accordance with claim 7 including tracer drive motor means for moving the tracer means.

9. A device for retrieving an end of yarn wound on a yarn-feed spool comprising:

means for generating an essentially tangentially directed current of air over a yarn-feed spool;

means for rotating the yarn-feed spool and the air current generating means relative to one another to bring an entire surface of the yarn-feed spool into contact with the air current;

at least one suction inlet including means for operating same in conjunction with one side of a yarn-feed spool for retrieving an end of yarn blown away from a surface of the spool;

and movable presentation means for bringing a yarn-feed spool on the one hand and the air current generating means and the suction inlet on the other hand, into proximity with each other;

wherein the presentation means comprises a movable carriage; a motor for driving the carriage; said air current generating means and said suction inlet being mounted on said carriage; and further including track means for supporting said carriage; roller means on the carriage for engaging the track means; a weaving machine disposed beneath the track means; and means for moving the carriage over the weaving machine via said track means.

10. A device for retrieving an end of yarn wound on a yarn-feed spool comprising:

means for generating an essentially tangentially directed current of air over a yarn-feed spool;

means for rotating the yarn-feed spool and the air current generating means relative to one another to bring an entire surface of the yarn-feed spool into contact with the air current;

at least one suction inlet including means for operating same in conjunction with one side of a yarn-feed spool for retrieving an end of yarn blown away from a surface of the spool;

and movable presentation means for bringing a yarn-feed spool on the one hand and the air current generating means and the suction inlet on the other hand, into proximity with each other;

wherein the presentation means comprises a movable carriage; a motor for driving the carriage; said air current generating means and said suction inlet being mounted on said carriage; and further wherein said carriage is provided with positioning means including an initial positioning means for initially positioning the carriage, and a telescopic, extendible sensor means for precisely positioning a sensor in respect of the yarn-feed spool whereby the sensor may make contact with the yarn-feed spool.

11. A device for retrieving an end of yarn wound on a yarn-feed spool comprising:

means for generating an essentially tangentially directed current of air over a yarn-feed spool;

means for rotating the yarn-feed spool and the air current generating means relative to one another to bring an entire surface of the yarn-feed spool into contact with the air current;

at least one suction inlet including means for operating same in conjunction with one side of the year-feed spool for retrieving an end of yarn blown away from a surface of the spool;

and movable presentation means for bringing the yarn-feed spool on the one hand and the air current generating means and the suction inlet on the other hand, into proximity with each other;

wherein said means for bringing the entire surface of a yarn-feed spool into contact with the air current includes a rotatable bobbin support; means for supporting the bobbin support; and drive means for rotating the bobbin support; and wherein the drive means and the air current generating means are both mounted on a common movable support.

12. A device in accordance to claim 11 wherein the drive means comprises a motor.

13. A device in accordance with claim 11 wherein the drive means and the rotatable bobbin support comprise a unitary assembly.

14. A device in accordance with claim 11 wherein the drive means is removably connected to the bobbin support in driving relationship; and further comprising drive positioning means for moving the drive means into and out of driving association with the bobbin support.

15. A device in accordance with claim 14 including an electromagnetic coupling connecting the drive means to the bobbin support.

16. A device in accordance with claim 11 including separable gearing for establishing a driving relationship between the drive means and the bobbin support.

17. A device in accordance with claim 11 wherein the means for rotating the yarn-feed spool includes channel means for receiving and transporting an end of a yarn wound on the yarn-feed spool.

18. A device in accordance with claim 11 wherein the rotatable bobbin support comprises two parts, including a first rotating part rotatable about an axis of rotation and a second part mounted on the first part; support means for the first rotating part; means for mounting a yarn-feed spool on the second part; and means for coupling the first and second parts in rotatable driving relationship and for securing same against axial separation along an axis of rotation.

19. A device for retrieving an end of yarn wound on a yarn-feed spool comprising:

means for generating an essentially tangentially directed current of air over a yarn-feed spool;

means for rotating the yarn-feed spool and the air current generating means relative to one another to bring an entire surface of the yarn-feed spool into contact with the air current;

at least one suction inlet including means for operating same in conjunction with one side of the yarn-feed spool for retrieving an end of yarn blown away from a surface of the spool;

and movable presentation means for bringing the yarn-feed spool on the one hand and the air current generating means and the suction inlet on the other hand, into proximity with each other;

wherein said means for bringing the entire surface of a yarn-feed spool into contact with the air current comprises a rotatable bobbin support, said bobbin support including a pneumatic work holding device for the yarn-feed spool; and means for supplying compressed air via said means for rotating the yarn-feed spool.

20. A device for retrieving an end of yarn wound on a yarn-feed spool comprising:

means for generating an essentially tangentially directed current of air over a yarn-feed spool;

means for rotating the yarn-feed spool and the air current generating means relative to one another to bring an entire surface of the yarn-feed spool into contact with the air current;

at least one suction inlet including means for operating same in conjunction with one side of the yarn-feed spool for retrieving an end of yarn blown away from a surface of the spool; and movable presentation means for bringing the yarn-feed spool on the one hand and the air current generating means and the suction inlet on the other hand, into proximity with each other;

wherein the air current generating means comprises a blade wheel spaced from the periphery of the yarn-feed spool, motor means for driving the blade wheel, and means connecting the blade wheel and motor means.

* * * * *